US006238320B1

(12) United States Patent
Flanagan

(10) Patent No.: US 6,238,320 B1
(45) Date of Patent: May 29, 2001

(54) MODULAR SUSPENDED FLOOR AND STEP ARRANGEMENT

(76) Inventor: Dennis Flanagan, 9 Highland Ave., Farmington, ME (US) 04938

( * ) Notice: Subject to any disclaimer, the term of this patent is extended or adjusted under 35 U.S.C. 154(b) by 0 days.

(21) Appl. No.: 09/329,172

(22) Filed: Jun. 9, 1999

(51) Int. Cl.[7] ..... A63B 21/00

(52) U.S. Cl. ..... 482/41; 482/130

(58) Field of Search ..... 482/42, 71, 130, 482/142, 41; 601/23, 41; 434/247, 265

(56) References Cited

U.S. PATENT DOCUMENTS 3,659,844 * 5/1972 Cummins ..... 482/130

* cited by examiner

*Primary Examiner*—Glenn E. Richman
(74) *Attorney, Agent, or Firm*—Dennis R. Haszko

(57) ABSTRACT

An exercise apparatus combining many modularized options on a single, portable suspended flooring that provides resilient surfaces to minimize compressive body stresses. The inventive design enables a variety of physical training and rehabilitative routines. The apparatus includes a step section that is adjustable in two-inch increments from two to eight inches, a pleiobox section, and a flooring section that provides a portable, stress-absorbing flooring suitable for dance and assorted physical training. Adjustable bars are provided to assist a user during exercise. The bars can be inclined to match the given step incline.

16 Claims, 13 Drawing Sheets

MODULAR SUSPENDED FLOOR AND STEP ARRANGEMENT

BACKGROUND OF THE INVENTION

1. Field of Invention

The present invention relates generally to the field of devices for exercise. More particularly, the present invention relates to a device for providing surfaces of variable height that have shock-absorbing characteristics. More particular yet, the present invention involves a modular arrangement of a suspended floor with variable step combinations for therapeutic and other exercise-related purposes. The present invention allows multiple exercise options in one compact adjustable unit.

2. Description of Prior-art

Within the field of exercise devices, there exist several types of fixed stepping platforms and some with adjustable features. Such stepping platforms are utilized in the performance of various aerobic exercise routines. Additionally, these prior-art devices have been used for therapeutic routines such as physical therapy for a recovering patient—such as, but not limited to, injured athletes and recovering stroke patients—or even as a trainer system for small children. These exercise and therapeutic routines typically involve stepping, jumping, hopping, bounding, or dancing movements. With respect to jumping exercise routines, such routines are commonly termed "step aerobics." With respect to therapeutic routines, such routines are technically termed "pleiometrics." Pleiometrics being the buoyant jumping activity exemplified by the common jumping movement of a basketball-player while rebounding a basketball. An individual through body movements performs the movements at issue in such routines.

Such routines involve basic movements initially and tend to become more complex according to the level of exercise instruction or therapeutic necessity. As the complexity of the movement increases, the versatility of the prior-art stepping platforms used is pushed to the limits. If adjustment is even possible, individuals may need to re-adjust or re-configure the platform during the activity. A protracted period of stepping-platform adjustment occurs when the mechanics of adjusting the stepping platform is involved and complex. The interruption necessitated by readjustment of such prior-art platforms results in delaying the exercise or therapy routines. This delay adversely affects the healthful effects of the given routine.

Still further, the prior-art up to this point have failed to present a design specifically tailored to proprioceptive and balance activities related to upright activities, and still be able to incrementally provide stepping features for exercise purposes. Indeed, much of the prior-art involves either cumbersome, stand-alone steps or fixed platforms that are inadequately resilient for proper and safe exercise or therapeutic purposes. Several prior-art devices exist which attempt to alleviate the problems as noted above. However, none of the patents mentioned herein touch upon the unique benefits and features of the present invention. More specifically, prior-art devices of Wilkinson (U.S. Pat. No. 5,512,026), Hodgdon (U.S. Pat. No. 5,474,509), Abboudi et al. (U.S. Pat. No. 5,399,134), and Timoney (U.S. Pat. No. 2,871,914) will be discussed below.

The prior-art device of Wilkinson includes a plurality of individual steps. The steps present stacking features that create variable-height steps. However, the Wilkinson device suffers from a significant lack of stability when the stacking occurs. More significantly, this prior-art device is limited to the steps and is devoid of any resilient platform sufficient for proper and safe exercise or therapeutic purposes.

The prior-art device of Hodgdon includes a platform that has a foldable step. This prior-art device is generally an arrangement of blocks that are hinged together so as to provide one single block that yields one step relative to the floor. Alternatively, the use of the foldable step via the hinge provides a stepped block that yields two steps relative to the floor. Although stabilized by tractioned surfaces, this prior-art device lacks versatility because it is limited to only two positions. As before, this prior-art device is limited to the steps and is devoid of any resilient platform sufficient for proper and safe exercise or therapeutic purposes.

The prior-art device of Abboudi et al. is well known in the exercise field as a stair stepping machine that mechanically simulates stair-climbing movement. While the movement of the steps does provide some degree of inherent resiliency and the handles afford some degree of safety, this prior-art fails to allow more natural movements of the user's lower extremities. That is to say, true climbing and descending movement with forward and backward motion cannot be accomplished via this device. Thus, this prior-art device is seen to be insufficient for proper exercise or therapeutic purposes.

The prior-art device of Timoney is a stair trainer that includes fixed steps located at both ends of a raised platform along with handrails on either side. This prior-art trainer device fails to show any resiliency useful for exercise or therapeutic routines. While a planar base is shown, it is only a flat rectangular piece and not flexible or suspended in any manner. Further, this prior-art device fails to provide any variable adjustability in regards to the step height.

None of the patents discussed above adequately provides for a resilient and variable floor or step arrangement that would be useful in a variety of configurations and for a variety of exercise or therapeutic routines. Commonly lacking in many of the prior-art devices, stability of the given floor or step arrangement is essential along with overall safety concerns. That is to say, any floor or step arrangement used in exercise or therapeutic routines should be designed with a tired, weakened, or disabled user in mind. This is particularly true for therapeutic routines performed in a physical therapy setting where a user's endurance level is typically not up to normal capacity. None of the prior-art devices teach or render obvious the floor and step arrangement of the present invention wherein the surface of both the floor and each step is suspended in a resilient manner so as to provide a modular system that is quickly and easily reconfigured for safe and varying use. Contemporary improvements in any prior-art devices have been limited to cumbersome designs that fail to produce a safe and effective suspended floor and step arrangement. The prior-art devices do not provide any compensation for step or platform stiffness, which is often undesirable in therapeutic routines.

Accordingly, it is desirable to provide for a new and improved, effective exercise and therapy device for providing proper surface buoyancy and adjustability for safe use during a variety of exercise and therapy routines. What is needed is such an exercise and therapy device that is easily operated. What is also needed is such an exercise and therapy device that can utilize easily manufactured and maintained parts. What is further needed is such an exercise and therapy device that does not require specialized skills for its use, but instead can be used in any exercise or therapy setting with or without the assistance of a professional trainer or therapist. Still, what is needed is such an exercise and therapy device that can be easily adjusted for any particular exercise or therapy routine. What is also needed is such an exercise and therapy device that includes adjustable steps along with relatedly adjustable guide rails. Still further, what is needed is such an exercise and therapy device that provides a fully buoyant arrangement. Yet still further, what is needed is such an exercise and therapy device which overcomes at least some of the disadvantages of the prior-art while providing new and useful buoyancy features.

SUMMARY OF THE INVENTION

It is an objective of the present invention to provide for a new and improved, effective exercise and therapy device for providing proper surface buoyancy and adjustability for safe use during a variety of exercise and therapy routines. It is another objective of the present invention to provide such an exercise and therapy device that is easily operated and can utilize easily manufactured and easily maintained parts. Still another objective of the present invention is to provide an exercise and therapy device that does not require specialized skills for its use, but instead can be used in any exercise or therapy setting with or without the assistance of a professional trainer or therapist depending on the uses. It is an objective of the present invention to provide such an exercise and therapy device that can be easily adjusted for any particular exercise or therapy routine. Another objective of the present invention is to provide such an exercise and therapy device that includes adjustable steps in combination with adjustable guide rails. Yet another objective of the present invention is to provide is such an exercise and therapy device that provides a fully buoyant arrangement in one compact efficient area.

While the general field of exercise involves problems associated with unforgiving surfaces that do not compensate for jarring vertical movements, the more specific field of physical therapy will be discussed. It should be noted that this discussion is limited to the specific field of physical therapy for the sole purpose of illustrative clarity and is not meant to limit the intended scope of the invention. Indeed, the inventive concepts disclosed herein may be utilized and thus realize benefits in any field related to physical activity such as, but not limited to, dancing, gymnastics, walking, jumping, and the like. The present invention is directed to a device that provides a fully buoyant arrangement of variable steps securable upon suspended flooring. It is desirable that the device of the current invention be fabricated from durable yet cost-effective materials e.g., steel and wood. While specific materials are mentioned herein, it should be understood that equally durable and cost-effective materials such as metal alloys, plastics, composites, or the like, could also be utilized without straying from the intended scope of the present invention.

The present invention is a therapy device in the form of a modular suspended floor and step arrangement. The therapy device includes a generally rectangular or square base. The base may be separated into sections for portability or may be a single piece that is set up once and not often moved. If portable, hinges or some other attachment means may be utilized in connecting the sections. The base includes a peripheral frame that supports a planar surface above any given underlying floor (e.g. concrete slab floor, tiled floor, wood floor, or other such underlying floors). The planar surface is separated from the underlying floor by a gap. Due to the inherent flexibility of the planar surface, this creates a suspended flooring with buoyancy characteristics. Depending upon the material used for the planar surface, the buoyancy may be altered as desired by changing the material. It should be noted that a peripheral frame of 2"×4" wooden members and a planar surface of ¾" wooden plywood is sufficient to provide the desirable buoyant characteristics. However, any suitably pliant sheet of composite materials may also be used.

Arranged on opposite sides along the frame, there are located holes that allow adjustment of steps (described later). Beneath each set of through-holes, there is a metal plate embedded in the underside of the frame. Each through-hole allows a threaded pin to pass therethrough and be secured to threaded-holes that are aligned within each through-hole. If so desired, threaded pins may be provided in varying lengths so as to match a desired step height. As well, the ends of each pin can be rounded in a bulbous manner for safety (as opposed to having a sharp edge). While three are discussed below, any number of boreholes with related threaded-holes may exist depending upon the overall size of the desired planar surface. Supports are secured to each corner of the frame. At each corner of the frame, there are placed through-holes with related counter-bores on the frame's underside to allow bolts or screws to secure each support from below. Alternatively, each support may be secured from above so long as the resulting attachment is durable and strong such that the supports may not be ripped out of place through the intended use of the invention.

Each support is permanently connected to a post. Each post is a vertically aligned, hollow, and metal tube. Although metal is used, any suitably strong alternative materials are possible—e.g., high impact plastic, glass fiber composites, . . . etc. The tube may be circular or square in cross-section, or any other suitable shape, so long as a mating adjustment-post may be arranged in a telescoping manner therewithin. Each adjustment-post thus fits within each related post and can be adjusted up or down. Each adjustment-post is secured within the given post by some means for re-settable attachment. The re-settable attachment may consist of a single hole in each post coupled to one of multiple holes in the given adjustment-post via a removable pin. However, it should be noted that any means for re-settable attachment may be used such as, but not limited to, a spring actuated button, a threaded knob, a cotter pin, a simple through-bolt, and the like. Further, it may be desirable to provide a locking means and a latching means. The latching means (i.e., a spring actuated button) would provide easy indexing and quick adjustability to each support, whereas the locking means (i.e., a cotter pin) would affirmatively secure each support from any movement. By using both a latching means and a locking means, adjustability is enhanced along with safety.

Rails are pivotably secured atop the adjustment-posts. On one set of adjustment-posts, the rails are attached via a single-pivot plate. On the other set of adjustment-posts, the rails are attached via a multi-pivot plate. Providing the multi-pivot plates allows the rails to be raised at only one end. That is to say, the set of adjustment-posts having the single-pivot plates can remain in position while the set of adjustment-posts having the multi-pivot plates are telescopingly elevated. During such inclined placement of the rails, the multi-pivot plates allow for the small horizontal displacement of the pivot point at the end having the multi-pivot plates. While the multi-pivot plate may be a plate having multiple holes and a single adjustable pivot pin, bolt, or threaded knob located therein, it is also possible that the multi-pivot plate have a slot that allows sliding horizontal movement of the multi-pivot plate about a fixed pivot-pin. Still further, the rails may consist of two parallel lengths or they may be a sectioned or contiguous U-shaped length.

While any material may be used for the rails, wood or some other material that is easily grasped—e.g., hard rubber, high-density plastic, . . . etc.—may be utilized to form the rails. Even further, chains or straps may be used in combination with the rails to afford more safety characteristics by surrounding the user's upper body with a complete loop.

The step elements of the present invention are formed in a manner similar to the suspended flooring. That is to say, step elements are provided that have a platform secured to a frame in a manner that gives the platform buoyant characteristics. Each step is generally a rectangular "mini-suspended floor" that includes through-holes on both of the short sides. These through-holes match up with any one pair of through-hole/threaded-hole sets located along the suspended flooring. This allows each step to be placed over the two removable threaded pins (as mentioned above) that are secured to the frame of the suspended flooring. Thus, the step or steps are secured from horizontal movement. The steps are designed to be formed in incremental thickness'. In this way, a 4" thick step and two 2" thick steps may be arranged to produce a single 8" thick step or a set of a set of stairs having 2" height variations therebetween.

In addition to the set of steps discussed above, there is also provided a pleiobox. The pleiobox is constructed in a manner similar to that of the steps. That is to say, the pleiobox includes a peripheral frame of 2"×4" wooden members and a planar surface of ¾" wooden plywood that is sufficient to provide desirable buoyant characteristics in the pleiobox's top surface. As with the steps, it should be noted that any suitably strong material may be used in forming frame members and any suitably pliant sheet of composite may be used in forming the top surface. The pleiobox is effectively a large fixed step that has a top surface that is at least twice as large as any step. The pleiobox is designed to be a top-most landing surface and also forms the top-most step. As the pleiobox is much larger than the steps, handles may be provided along the sides of the pleiobox. The handles may be separate hardware or may be integral cutouts. The pleiobox is held in place by a combination of any of its weight, its shape (to abut the support plates), and/or clasps that couple the pleiobox to the bottom-most step.

In operation, each step is secured in a desired configuration via the removable pins. The rails are adjusted in accordance with the step configuration via the adjustment-posts. A user then performs any variety of physical therapy (or other physical activity) thereupon. During such activity, the user benefits from the forgiving buoyancy of the suspended platform and buoyant steps. Specifically and more importantly, the buoyancy of the suspended platform is transmitted via each step which are themselves also buoyantly suspended. That is to say, a user that utilizes a full stepping arrangement (e.g., two adjacent steps secured adjacent to the pleiobox and over the suspended flooring) will encounter resiliency underfoot that is highly beneficial for jumping and assorted proprioceptive and balance exercises. It should be noted that the removable pins might be of varying length for arrangement of the various step heights with or without the pleiobox.

The invention will be described for the purposes of illustration only in connection with a preferred embodiment; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENT

The present invention is directed to an exercise device useful for performing exercise and therapeutic routines. The exercise device includes three primary elements in a modular arrangement. Each of these primary elements include the same underlying concept of a buoyant surface. Specifically, these primary elements include suspended flooring, a set of modularized steps, and a pleiobox. The steps are formed in differing heights such that several arrangements of steps with varying heights and widths are possible. In cooperation with the given step incline (especially when the pleiobox is used), adjustable guide rails are provided that can each be secured in an inclined or horizontal position. The guide rails can also be used to support movable straps that may be secured to the user if necessary. The inventive exercise device and the variations thereof are discussed in more detail hereinbelow with respect to the drawings.

Figure 1:
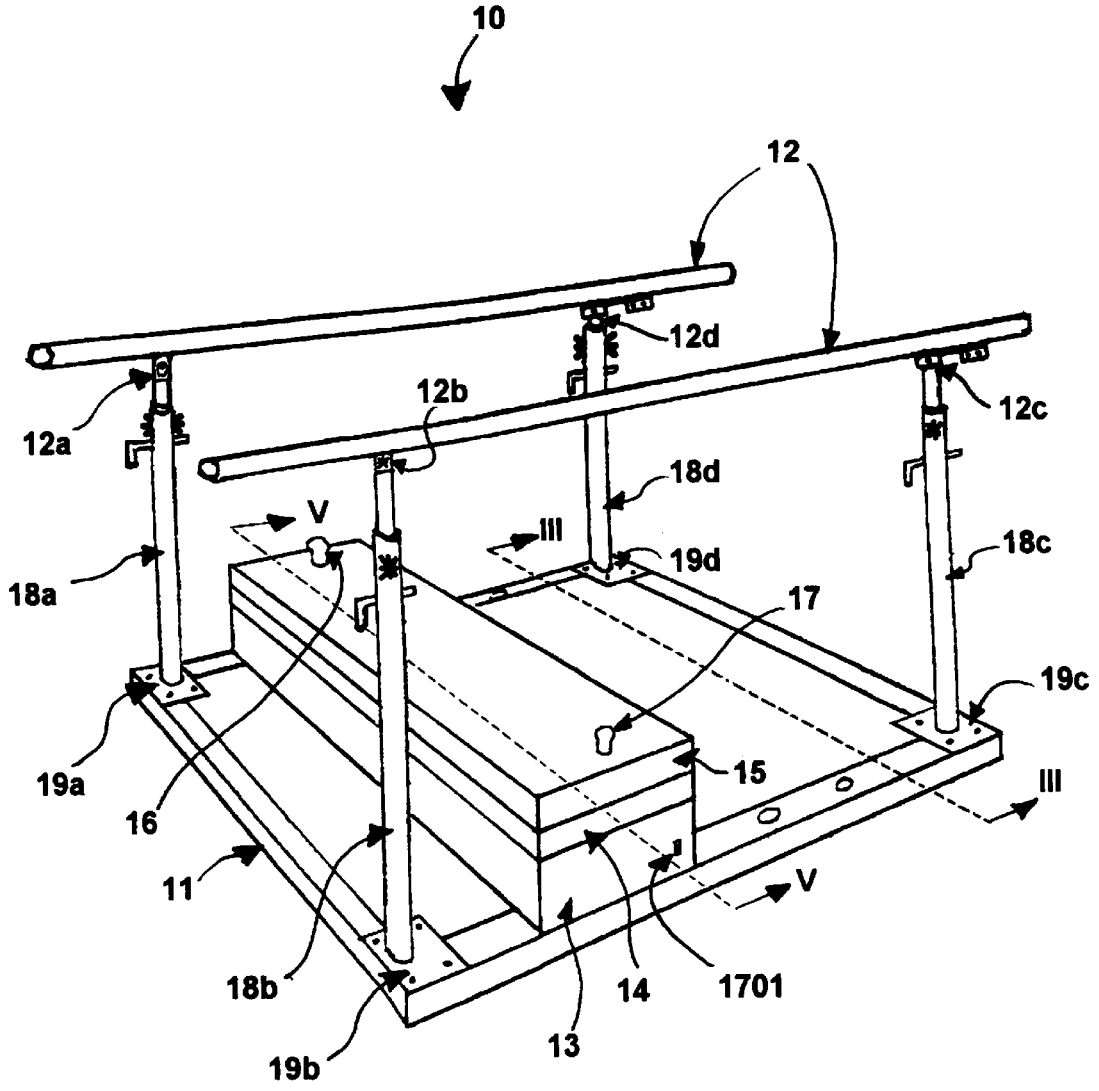
FIG. 1 is a perspective view of the suspended floor and step arrangement using three stacked steps according to the present invention.
Figure 1A:
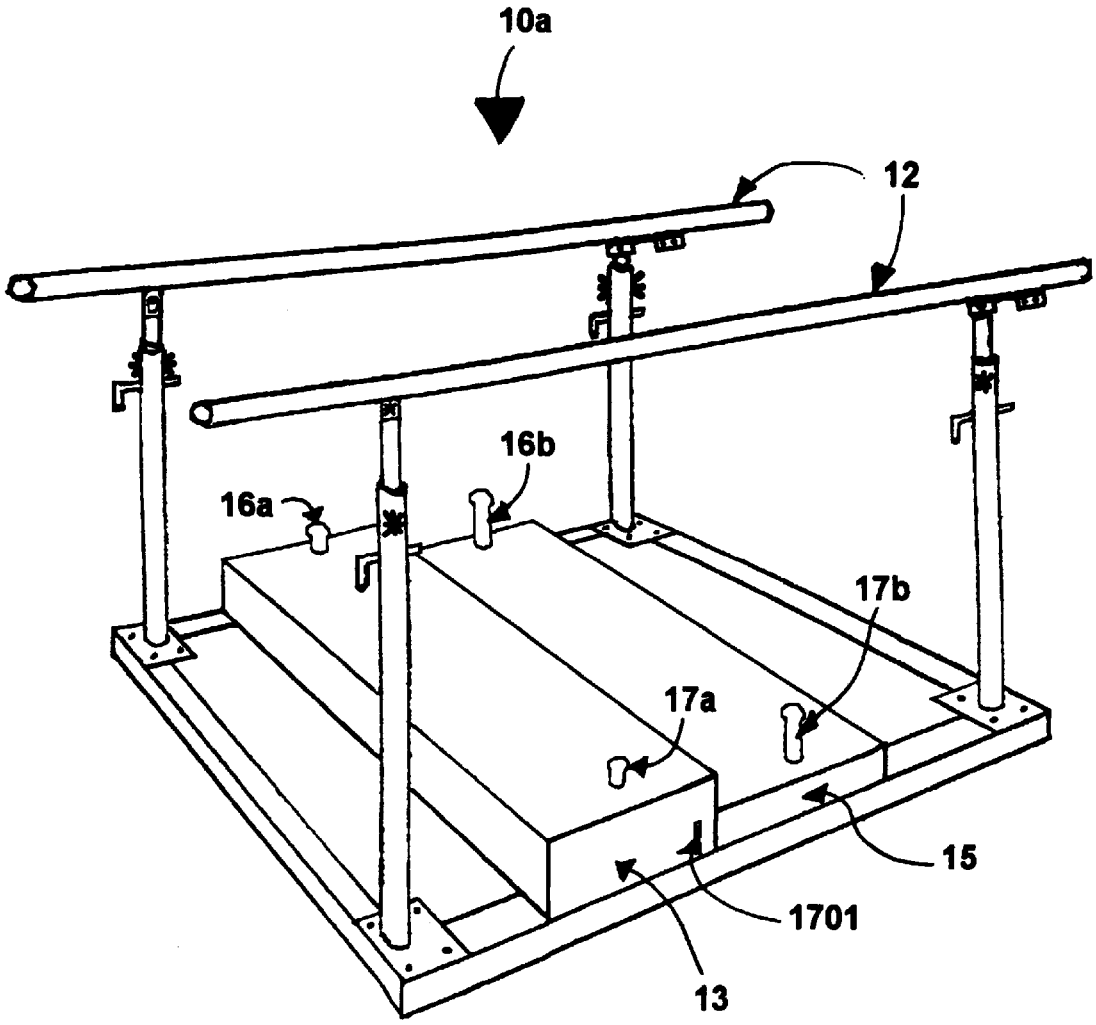
FIG. 1A is a perspective view of the suspended floor and step arrangement using two steps placed adjacently according to the present invention.
Figure 1B:
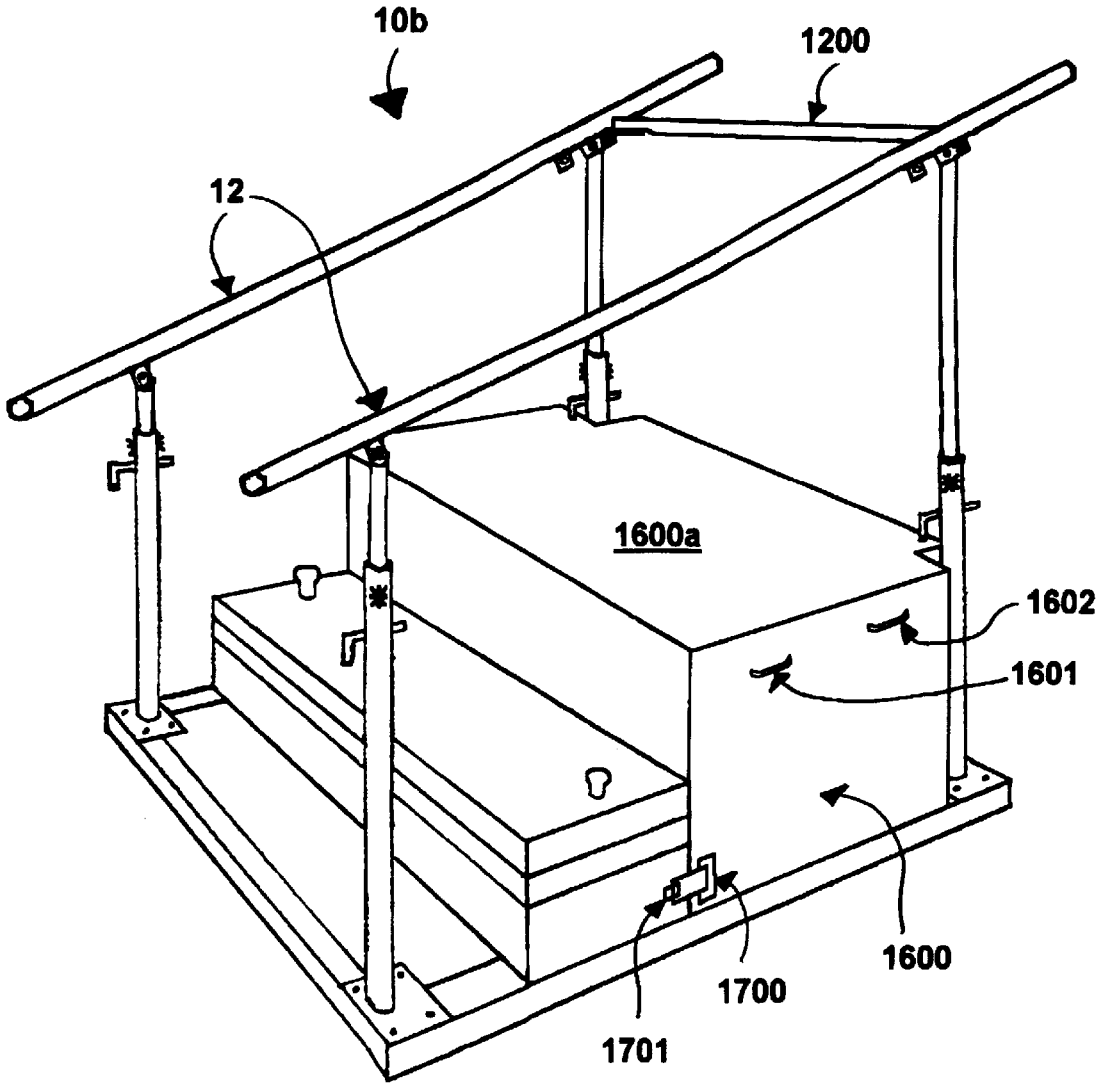
FIG. 1B is a perspective view of the suspended floor and step arrangement using the three stacked steps as shown in FIG. 1 along with a pleiobox according to the present invention.

Referring now to FIGS. 1, 1A, and 1B there are shown three configurations of the exercise device according to the preferred embodiment of the present invention. In FIG. 1, a first configuration 10 of the exercise device includes a suspended flooring 11 and steps 13, 14, 15. While three steps 13, 14, 15 are shown and configured atop one another, it should be noted that any number of steps may be provided and configured in any desired arrangement. The steps 13, 14, 15 are secured against horizontal movement by pins 16 and 17 that run through the frame of each step 13, 14, 15 and threadingly into the frame of the suspended flooring 11. While the present invention may be formed by only the suspended flooring 11 with or without the steps 13, 14, 15, the addition of adjustable posts 18*a*–18*d* with attached guide rails 12 provide increased safety in use of the exercise device 10.

With continued reference to FIG. 1, it can be seen that the guide rails 12 are adjustable in a telescoping manner and are each fixed at the corners of the suspended flooring 11 via support plates 19*a*–19*d*. It is preferable that the adjustable posts 18*a*–18*d* and support plates 19*a*–19*d* be fabricated from a strong, durable material such as steel or similarly strong alloy. The adjustable posts 18*a*–18*d* can be raised and lowered (as described later with respect to FIGS. 7 and 8) to effect movement of the guide rails 12. The guide rails 12 can be raised together for taller users of the exercise device 10 or lowered for shorter users. Further, when the steps are arranged steeply, adjustable posts 18*a* and 18*b* can remain in place while adjustable posts 18*c* and 18*d* are raised. This allows the guide rails 12 to assume an inclined position via single-pivot plates 12*a* and 12*b* in cooperation with multi-pivot plates 12*c* and 12*d*. The operation of single-pivot plates 12*a*, 12*b* and multi-pivot plates 12*c*, 12*d* will be discussed with respect to FIGS. 9–14.

In FIG. 1A, a second configuration 10*a* of the exercise device again includes the suspended flooring 11 but now only includes steps 13 and 15. The steps 13 and 15 are secured against horizontal movement by pins 16*a*, 17*a* and 16*b*, 17*b* that run through the frame of each step 13 and 15, respectively, and threadingly into the frame of the suspended flooring 11. Pins 16*a*, 17*a* and 16*b*, 17*b* that run through the frame of each step 13 and 15 are preferably constant in length as the steps differ in height from two to eight inches. However, it should be understood that for steps totaling ten to fourteen inches in differing height, differing pin lengths could be provided. In such cases, pins 16*a* and 17*a* could be longer than pins 16*b* and 17*b* for aesthetics as well as safety.

Still further, in FIG. 1B, a third configuration 10*b* of the exercise device includes the suspended flooring 11 and the steps 13, 14, and 15 arranged as shown in FIG. 1. However, a pleiobox 1600 is positioned adjacent to the steps 13–15. Handles 1601 and 1602 (handles on opposite side of the pleiobox are not visible) allow easier movement and positioning of the pleiobox 1600 by a user. The pleiobox 1600 is secured against horizontal movement primarily by way of a pair (only one side visible) of clasps 1700 that are each connected to a clip 1701 located on the bottom-most step 13. It should be noted that the guide rails 12 are shown in an inclined position via single-pivot plates 12*a* and 12*b* in cooperation with multi-pivot plates 12*c* and 12*d*. Further, a cross rail 1200 is connected between the guide rails 12 in order to prevent a user from falling from the pleiobox top surface 1600*a*. The cross rail 1200 also assists a user in turning atop the pleiobox top surface 1600*a*. The cross rail 1200 and pleiobox 1600 will be discussed in more detail with reference below to FIGS. 19–21. It should be understood that FIGS. 1, 1A, and 1B represent only three possible configurations and that numerous arrangements of the modular elements (i.e., steps, pleiobox, flooring, and rails) are possible. Indeed, such modularity directly increases the usefulness of the present invention.

Figure 2:
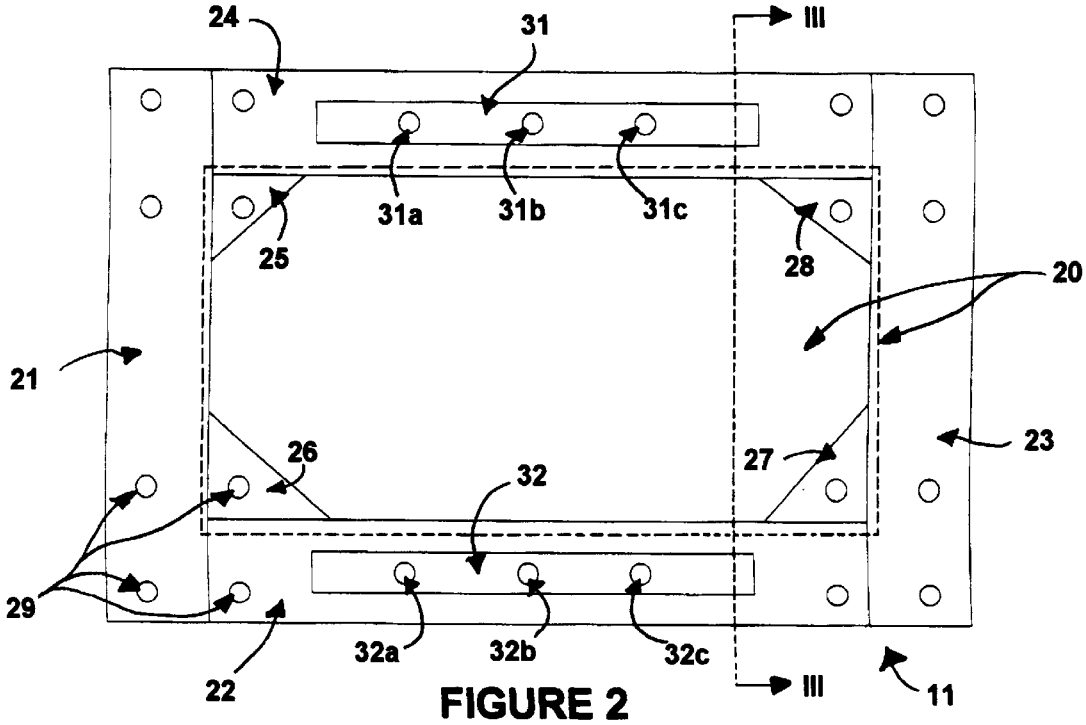
FIG. 2 is a bottom view of the suspended floor of the invention as shown in FIG. 1.

Referring now to FIG. 2, the suspended flooring 11 is shown from its underside. From this view, a floor-platform 20 is shown with its border indicated by dotted lines. The floor-platform 20 is secured to frame members 21–24 by any known method such as, but not limited to, nails, screws, glue or binding agent, or some combination thereof. The floor-platform 20 itself is preferably fabricated from a single sheet of plywood having a thickness of ¾" or some other unitary sheet having similar buoyant properties. To add structural integrity to the frame members 21–24, there are provided wedge-shaped corner-supports 25–28. The frame members 21–24 and corner-supports 25–28 are all preferably formed by easily available materials such as, but not limited to, 2"×4" lumber.

At the corner areas of the suspended flooring 11, there are located boreholes 29. The boreholes are formed in the frame members 21–24 and corner-supports 25–28 in order to provide a through-bolt (not shown) or some similar fastening means to secure each support-plate 19*a*–19*d* atop the suspended flooring (see FIGS. 1, 1A, and 1B). The boreholes 29 may be counter-bored so as to prevent any fastening means (e.g., through-bolt) from protruding past the bottom surface of the suspended flooring 11. Further, pin-plates 31 and 32 are embedded within frame members 24 and 22, respectively. Each pin-plate 31 and 32 includes a plurality of threaded-holes 31*a*–*c* and 32*a*–*c*, respectively. The threaded-holes 31*a*–*c* and 32*a*–*c* allow pins 16 and 17 to be threadingly secured therein. Though not shown, it should be understood that boreholes exist within frame members 22 and 24 that are aligned with threaded-holes 31*a*–*c* and 32*a*–*c* so as to allow passage therethrough of pins 16 and 17. While three threaded-holes per each pin-plate is preferred, it should be understood that additional pin-plates may be used if the overall length of the suspended flooring 11 were increased. Such modifications being well within the scope of the present invention.

Figure 3:
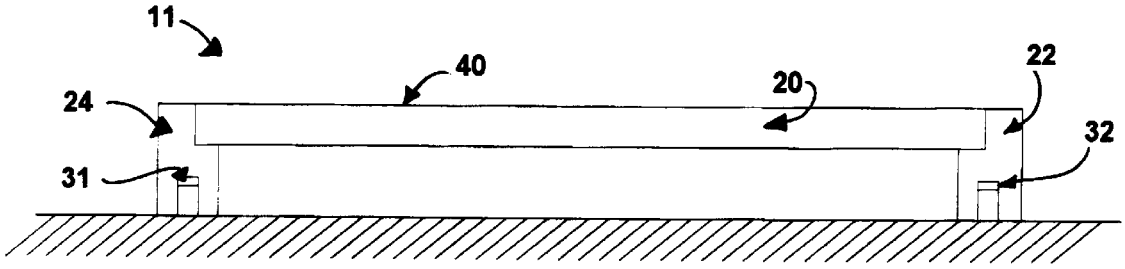
FIG. 3 is a cross-sectional view of the suspended floor taken along the line III—III in FIG. 1.
Figure 4:
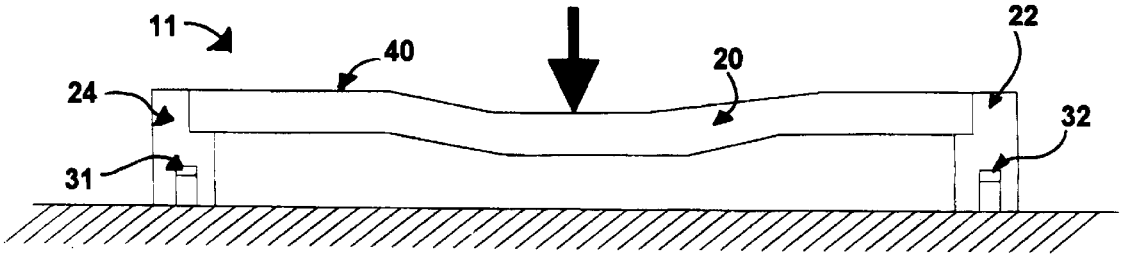
FIG. 4 is the same cross-sectional view as FIG. 3, but showing an exaggerated downward flex of the suspended floor's surface.

In FIGS. 3 and 4, a cross-section of the suspended flooring 11 taken across line III—III (see FIGS. 1 and 2) is shown. Both FIGS. 3 and 4 show the floor-platform 20 secured flush within frame members 22 and 24 so as to produce a smooth top surface 40. As well, the pin-plates 31 and 32 can be seen in their embedded position within frame members 22 and 24. Preferably, the pins 16, 17 and the pin-plates 31, 32 are formed from some durable metallic material such as steel. While FIGS. 3 and 4 are structurally identical, FIG. 4 shows the result of a force (indicated by a large downward arrow) upon the top surface 40. Exaggerated for purposes of illustration, a downward force on the top surface 40 will produce a flex in the pliant floor-platform 20. It is this pliancy that creates the overall desirable buoyant characteristic in the suspended flooring 11. With this in mind, it should be understood that buoyancy may be altered (increased or decreased) as desired by utilizing different materials for the floor-platform 20.

Figure 5:
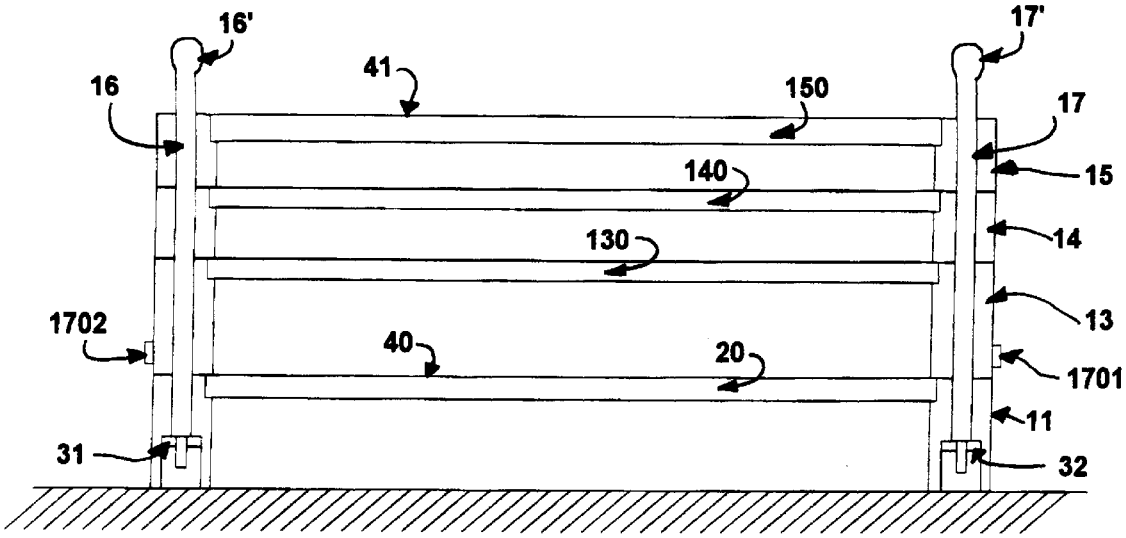
FIG. 5 is a cross-sectional view of the suspended floor and steps taken along the line V—V in FIG. 1.
Figure 6:
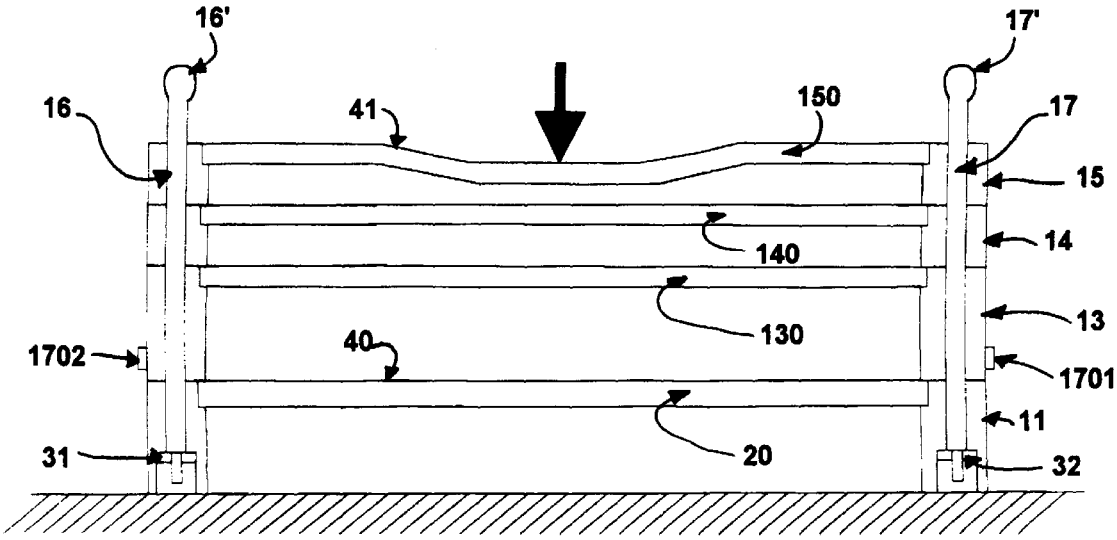
FIG. 6 is the same cross-sectional view as FIG. 5, but showing an exaggerated downward flex of each step down to the suspended floor's surface.

Similar to FIGS. 3 and 4, FIGS. 5 and 6 show the buoyancy characteristics of the top step surface 41. In FIGS. 5 and 6, a cross-section of the suspended flooring 11 and steps 13–15 taken across line V—V from FIG. 1 is shown. Both FIGS. 3 and 4 show the steps 13–15 secured from horizontal movement via pins 16 and 17. The pins 16 and 17 each include bulbous ends 16' and 17' that prevent injury if contacted by a user due to the lack of sharp edges. Further, the bulbous ends 16' and 17' help maintain the steps 13–15 in place vertically. As before, the pin-plates 31 and 32 can be seen in their embedded position within frame members 22 and 24. Moreover, the pins 16, 17 are shown threadingly attached to the pin-plates 31, 32, respectively. As in FIG. 4, FIG. 6 shows the result of a force (indicated by a large downward arrow) upon the top step surface 41. Such a downward force on the top step surface 41 produce a flex (shown exaggerated for purposes of illustration) in the pliant step-platform 150. As in the pliant floor-platform 20, it is this pliancy that creates the overall desirable buoyant characteristic in the step 15. It should be readily understood that such buoyancy exists in each step surface 130, 140 and 150 related to each step 13, 14, and 15, respectively as shown. This results in buoyant resiliency over the entire top surface of the exercise device 10 regardless of the given step arrangement or absence thereof.

Figure 7:
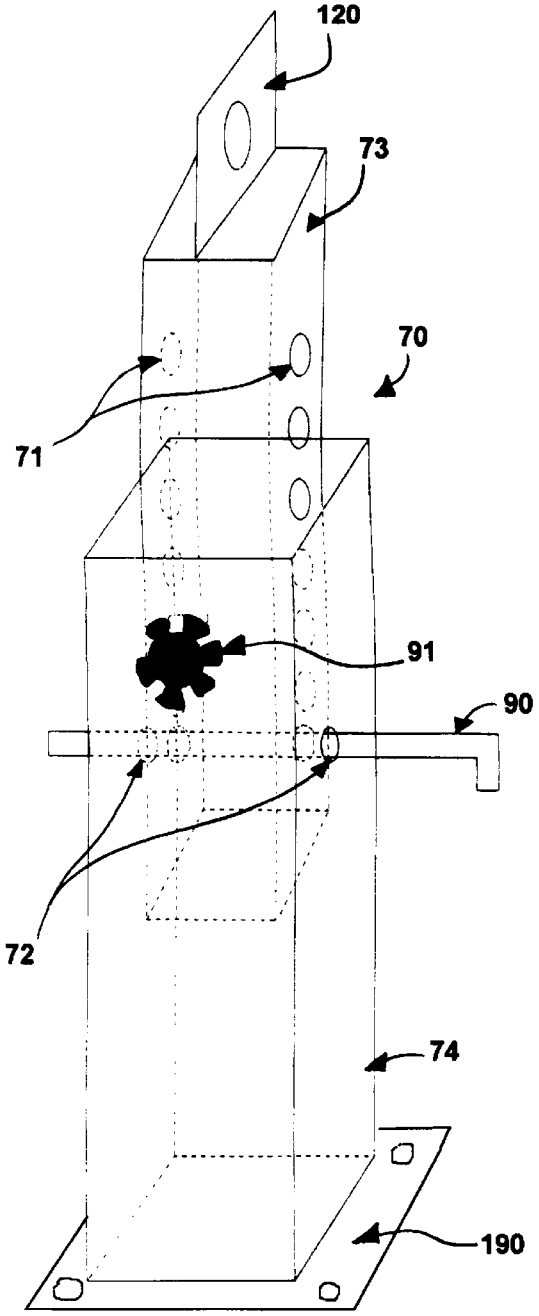
FIG. 7 is a perspective view of a post according to an alternative embodiment of the present invention.
Figure 8:
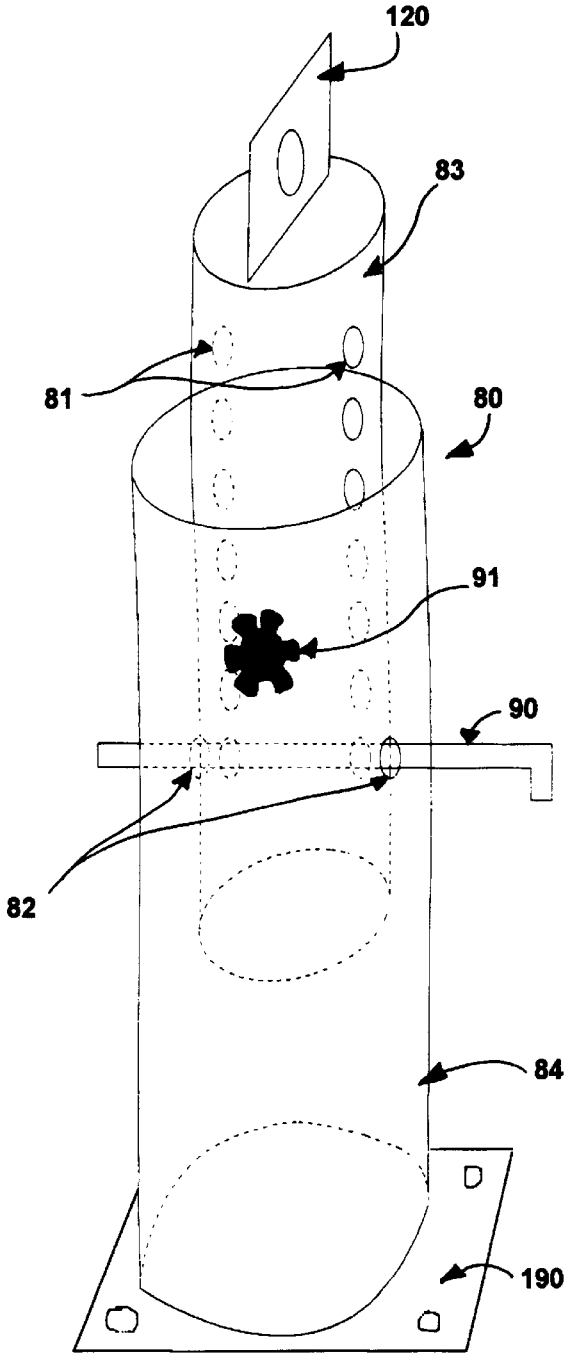
FIG. 8 is a perspective view of one of the posts of the present invention as shown in FIG. 1.

FIGS. 7 and 8 show two types of adjustable posts (reduced in scale for clarity of illustration). FIG. 7 shows a square post 70, while FIG. 8 shows a cylindrical post 80. It is noted that the type shown in FIG. 1 (elements 18*a–d*) is a cylindrical type. However, any cross-sectional shape may be utilized including triangular, hexagonal, and octagonal shapes. Indeed, shapes other than perfectly round cylinders have the unique benefit of enhancing the alignment of inner-holes 71 (81) with outer holes 72 (82) in FIG. 7 (FIG. 8). Common to both FIGS. 7 and 8 are the fixed-pivot plate 120 and the post-support plate 190 that are welded or otherwise permanently affixed, respectively, to the tops and bottoms of the square post 70 and cylindrical post 80 by some welding procedure or otherwise permanent mounting.

Two parts form the square post 70: an upper section 73 and a lower section 74. The upper section 73 is of a smaller diameter of the inside of the hollow lower section 74. This allows a telescoping adjustment that can be set by placement of an index-pin 90 through the desired aligned inner-holes 71 with outer holes 72. Such an index-pin 90 should be considered a latching means for providing easy indexing and quick adjustability to each support. A threaded knob 91 is also provided that is threaded through a hole (not visible) in the lower section 74 so as to abut the upper section 73. By screwing the threaded knob tighter against the upper section 73, the threaded knob 91 serves as a locking means to affirmatively secure each support from any movement. By using both a latching means (e.g., index-pin 90) and a locking means (e.g., threaded knob 91), adjustability is enhanced along with safety. This is because the tightened threaded knob 91 prevents inadvertent telescoping movement even if the index-pin 90 is accidentally knocked out of place.

Similarly, the cylindrical post 80 is formed by an upper section 83 and a lower section 84 where the upper section 83 is of a smaller diameter of the inside of the hollow lower section 84. Again, this allows a telescoping adjustment that can be set by placement of the index-pin 90 through the desired aligned inner-holes 81 with outer holes 82. As well, the threaded knob 91 serves as a locking means to affirmatively secure each support from any movement.

Figure 9:
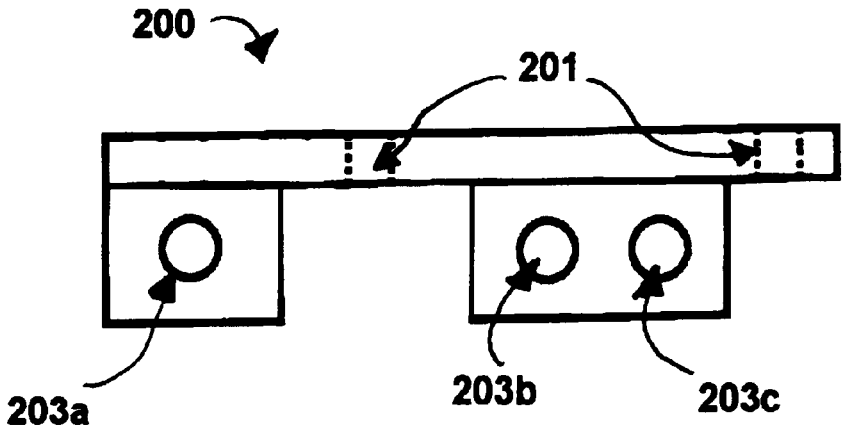
FIG. 9 is a side view of one of the multi-pivot plates of the invention as shown in FIG. 1.
Figure 10:
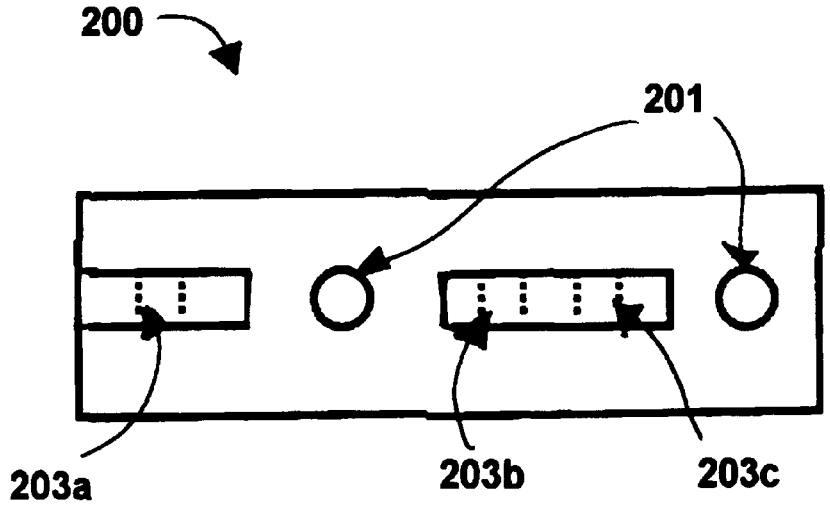
FIG. 10 is a bottom view of the multi-pivot plate shown in FIG. 9.
Figure 11:
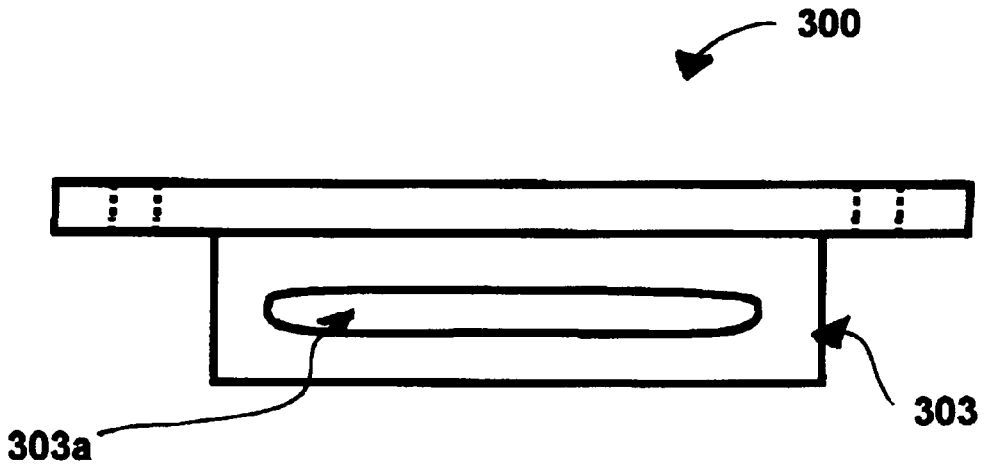
FIG. 11 is a side view of an alternative embodiment of the multi-pivot plate.
Figure 12:
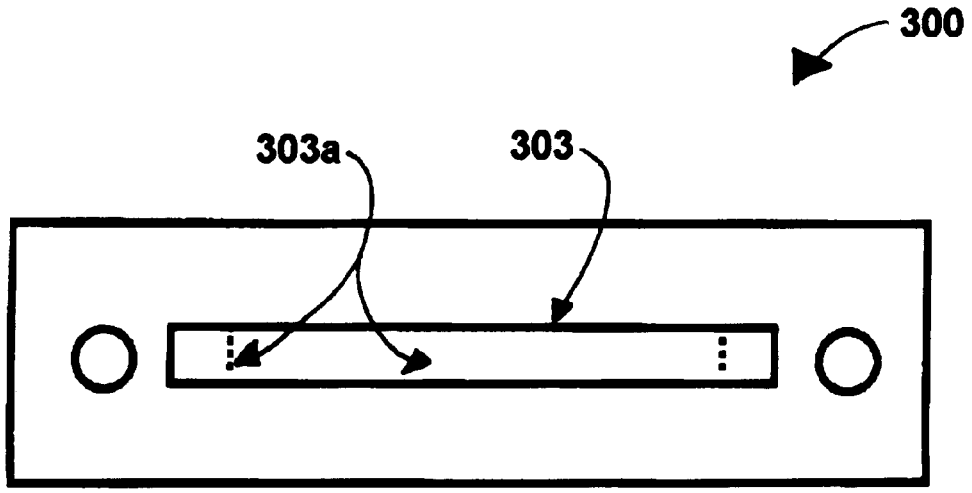
FIG. 12 is a bottom view of the alternative multi-pivot plate shown in FIG. 11.

The fixed-pivot plate 120 seen in FIGS. 7 and 8 are secured to the guide rails 12 (see FIG. 1) by way of either a single-pivot plate (12*a*, 12*b*) or a multi-pivot plate (12*c*, 12*d*). In FIGS. 9 and 10, a multi-pivot plate 200 is of the type shown by the multi-pivot plates 12*c*, 12*d* of FIG. 1. The multi-pivot plate 200 includes multiple holes 201 that allow attachment to the guide rails 12. Attachment is possible by any secure fastening means, though preferably strong screws. Again, it is noted that the guide rails 12 are preferably wood and the multi-pivot plate 200 is preferably steel. The points of attachment where the multi-pivot plate 200 is connected to the guide rails 12 are preferably smoothly flattened undersurfaces of the guide rail 12. Conversely, it is possible that the top of the multi-pivot plate 200 may itself be curved so as to cup the underside of the guide rails 12 if they were not flattened but curved. Either design being well within the intended scope of the present invention.

During telescoping adjustment of the adjustable posts 18*c* and 18*d* in FIG. 1 when adjustable posts 18*a* and 18*b* are not adjusted, the pivot point of multi-pivot plates 12*c* and 12*d* will effectively shift horizontally. It is this horizontal shifting that requires the use of multiple pivot points. FIGS. 9 and 10 include multiple pivot points 203*a–c*. At any given point of adjustment, one of the multiple pivot points 203*a–c*, will be secured to the fixed-pivot plate 120 (see FIGS. 7 and 8) by any suitably secure yet removable fastening means such as a wing-nut/bolt combination. While multiple inclined positions of the guide rails 12 may be gained by the presence of only three pivot points 203*a–c*, it should be noted that more pivot points may be desired. Further, FIGS. 11 and 12 detail an alternative to fixed pivot points. The multi-pivot plate 300 in FIGS. 11 and 12 include a single, elongated slot 303*a* within the long-fin 303 instead of multiple pivot points 203*a–c*. By providing a slot 303*a*, the number of incline positions of the guide rails 12 is greatly enhanced.

Figure 13:
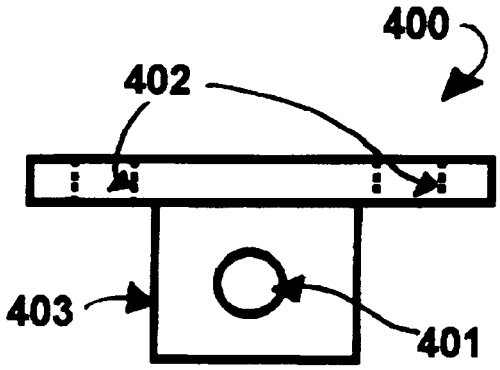
FIG. 13 is a side view of one of the single-pivot plates of the invention as shown in FIG. 1.
Figure 14:
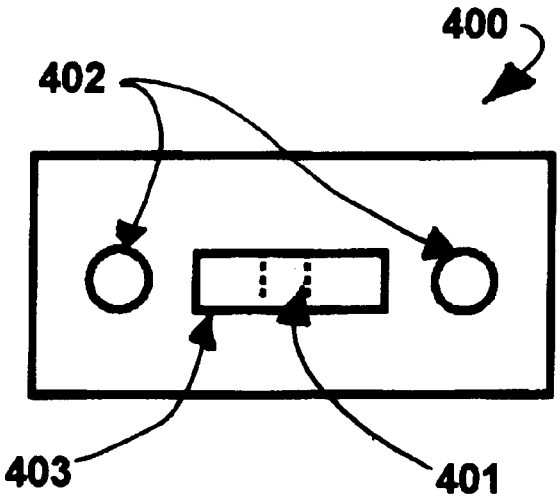
FIG. 14 is a bottom view of the single-pivot plate shown in FIG. 13.

In FIGS. 13 and 14, a single-pivot plate 400 is of the type shown by the single-pivot plates 12*a*, 12*b* of FIG. 1. The single-pivot plate 400 includes a multiple holes 402 that allow attachment to the guide rails 12. In a manner similar to the multi-pivot plates 200 and 300, attachment is possible by any secure fastening means, though preferably strong screws. The single-pivot plate 400 is preferably steel. As before, the single-pivot plate 400 is connected to at smoothly flattened undersurfaces of the guide rails 12. However, it is possible that the top of the single-pivot plate 400 be curved so as to cup the curved guide rails 12. Again, either design is well within the intended scope of the present invention.

With continued reference to FIGS. 13 and 14, there is shown a short-fin 403 that includes a single pivot point 401. The single pivot point 401 is secured to the fixed-pivot plate 120 (see FIGS. 7 and 8) by any suitably secure fastening means that allows rotation of the single-pivot plate 400 relative to the fixed-pivot plate 120. During telescoping adjustment of the adjustable posts 18*c* and 18*d* in FIG. 1 when adjustable posts 18*a* and 18*b* are not adjusted, the single-pivot plate 400 will be secured to the fixed-pivot plate 120 yet rotate freely thereabout via the single pivot point 403.

In FIGS. 15 through 18, the two configurations of the steps are shown. The modular characteristics of the present invention are embodied through the use of multiple steps having heights of 2" and 4" such that an aggregate step is possible with heights ranging from 2" to 8" in total. For example, in FIG. 1, two 2" steps are shown in position atop a 4" step. It should be noted that each step may, of course, be formed in any desired set of dimensions (e.g., 3" and 6" heights). However, it has been found that using increments of 2" enhances modularity.

Figure 15:
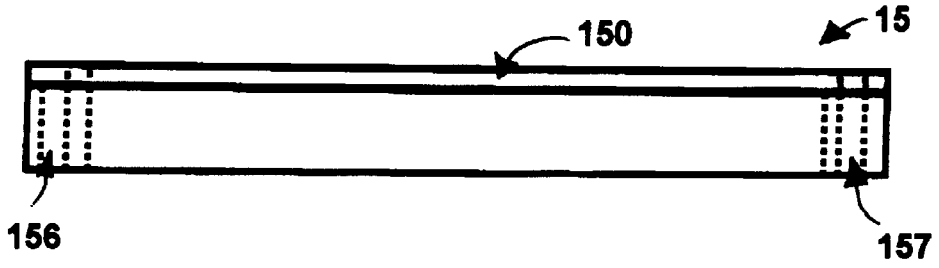
FIG. 15 is a side view of one of the smaller top steps of the invention as shown in FIG. 1.
Figure 16:
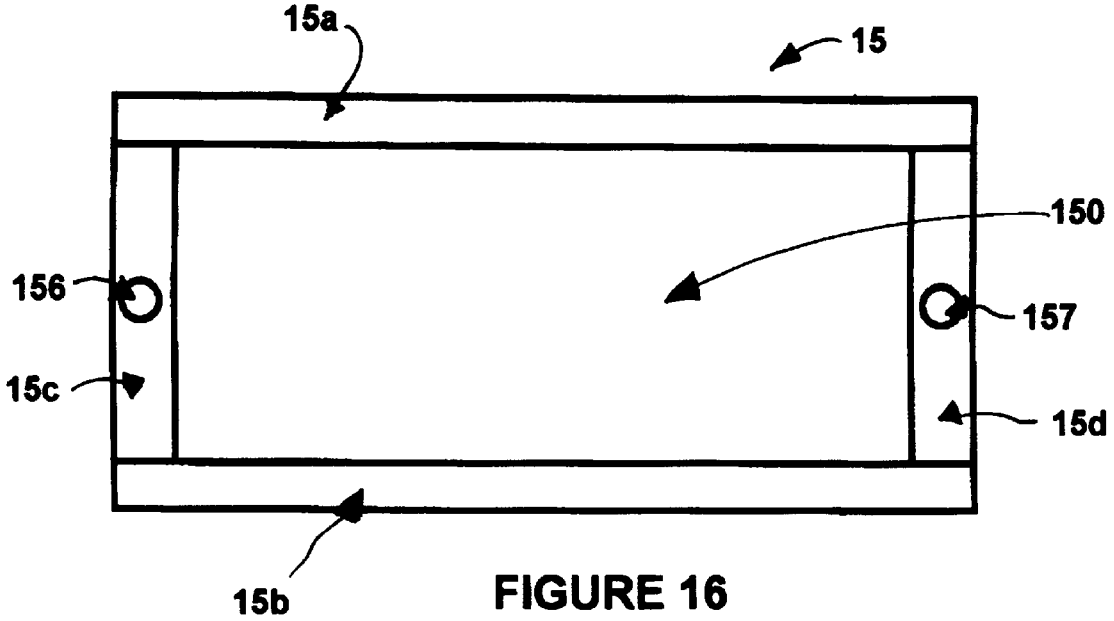
FIG. 16 is a top view of the smaller top step of the invention as shown in FIG. 15.

More specifically, FIGS. 15 and 16 show side and bottom views, respectively, of the step 15 shown in FIG. 1. The step 15 includes through holes 156 and 157 that allow passage of pins 16 and 17 therethrough (see FIGS. 1, 5, and 6). FIG. 16 shows the step 15 from its underside. Similar to the suspended flooring 11, the step 15 includes a step-platform 150 that is secured to frame members 15*a–d* by any known method such as, but not limited to, nails, screws, glue or binding agent, or some combination thereof. The step-platform 150 itself is preferably fabricated from a single sheet of plywood having a thickness of ¾" or some other unitary sheet having similar buoyant properties. The frame members 15*a–d* are preferably formed by easily available materials such as, but not limited to, 2"×4" lumber.

Figure 17:
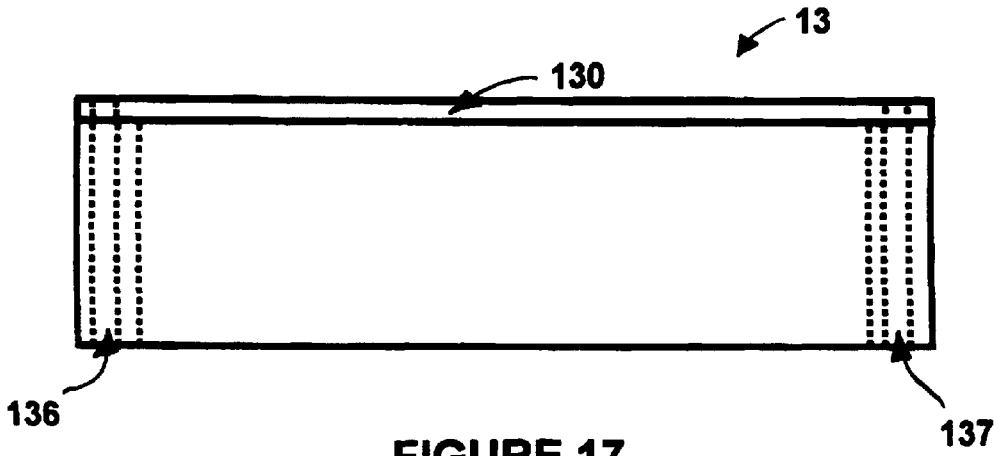
FIG. 17 is a side view of one of the larger top step of the invention as shown in FIG. 1.
Figure 18:
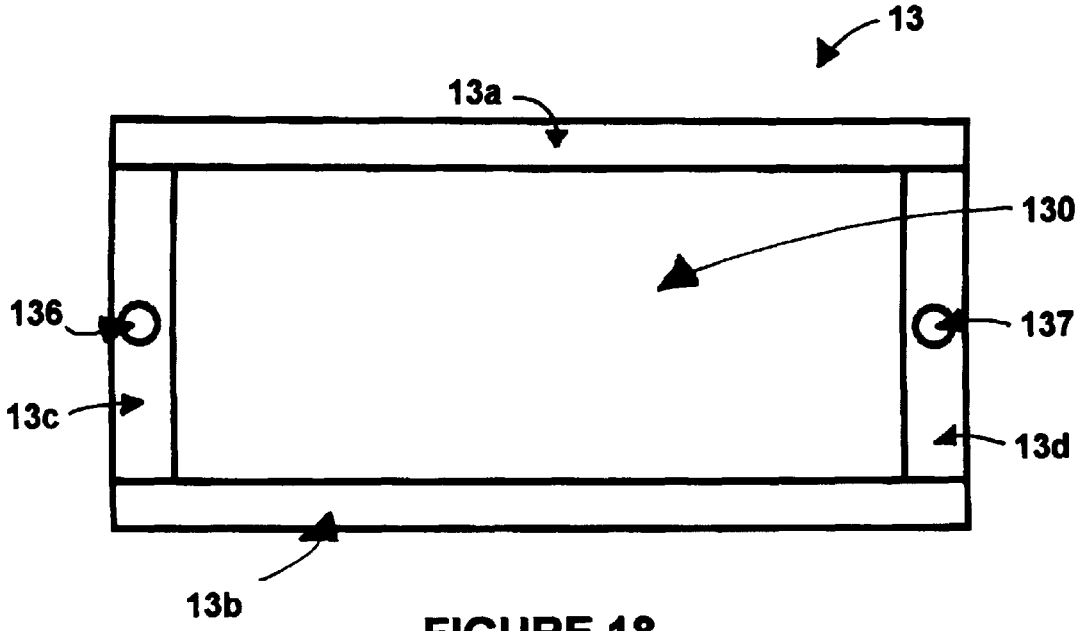
FIG. 18 is a top view of the larger top step of the invention as shown in FIG. 17.

Similarly, FIGS. 17 and 18 show side and bottom views, respectively, of the step 13 shown in FIG. 1. The step 13 includes through-holes 136 and 137 that also allow passage of pins 16 and 17 therethrough (see FIGS. 1, 5, and 6). FIG. 18 shows the step 13 from its underside. As in step 15 and similar to the suspended flooring 11, the step 13 includes a step-platform 130 that is suitably secured to frame members 13*a–d*. The only difference between the step 15 in FIG. 15 and the step 13 in FIG. 17 being that step 13 is roughly twice the height of step 15 (e.g., 4" and 2" respectively).

Figure 19:
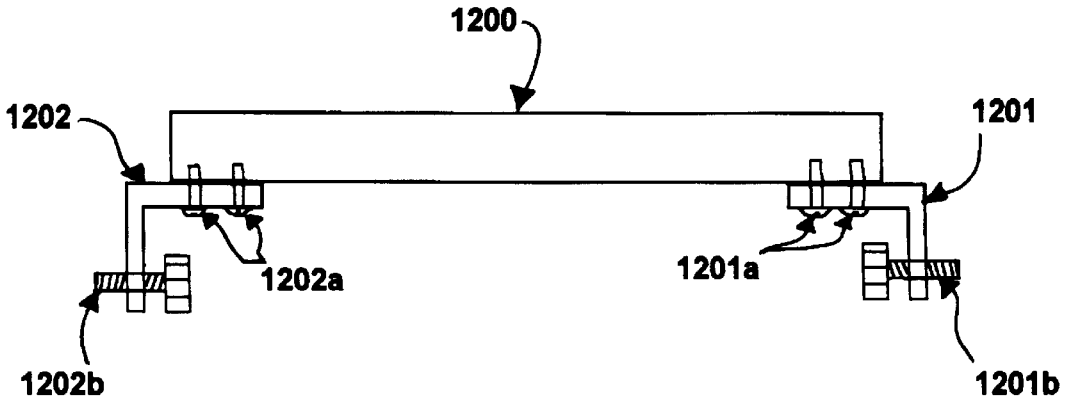
FIG. 19 is a side view of the cross rail of the invention as shown in FIG. 1B.

In FIG. 19, the cross rail 1200 (shown in FIG. 1B) is detailed. The cross rail 1200 is formed of the same material as the guide rails 12—e.g., wood, hard rubber, or some similarly suitable composite. Also, cross-connection plates 1201 and 1202 are held in place via screws 1201*a* and 1202*a*, respectively. The cross-connection plates 1201 and 1202 are fabricated—preferably from metal—similarly to the elements shown in FIGS. 9–14. The cross-connection plates 1201 and 1202 are secured to the multi-pivot plate 200 (in any unused set of holes 203*a–c*) or the multi-pivot plate 300 (in any unused area of the slot 303*a*) via threaded knobs 1201*b* and 1202*b* as can be seen in FIGURE 1B. It should be understood that the use of threaded knobs 1201*b* and 1202*b* creates a quick and easy manner in which the cross rail 1200 may be added or removed as desired.

Figure 20:
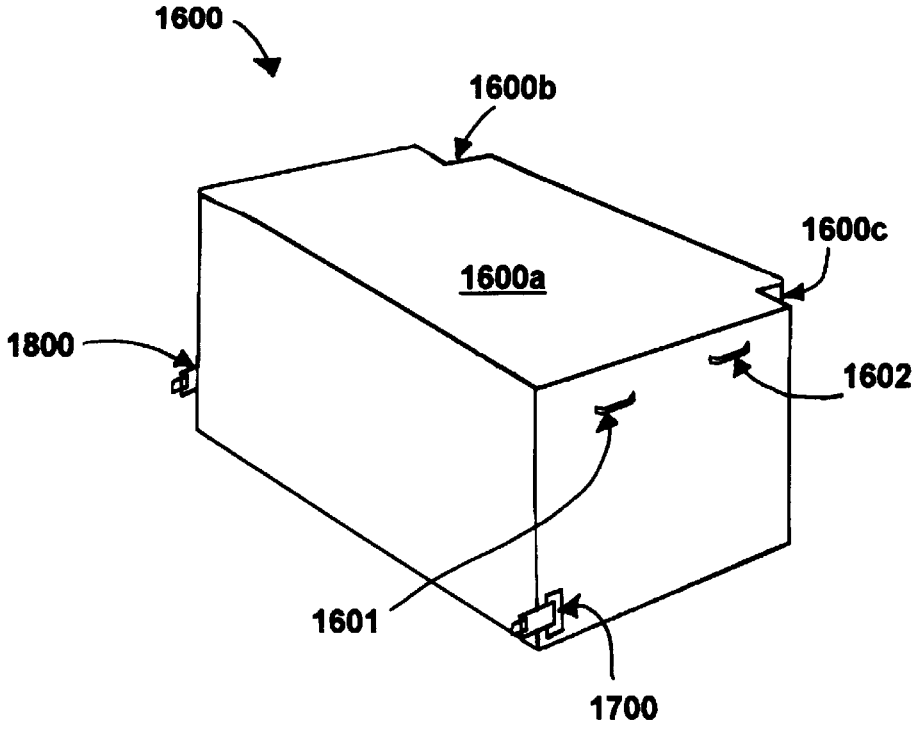
FIG. 20 is a perspective view of the pleiobox of the invention as shown in FIG. 1B.
Figure 21:
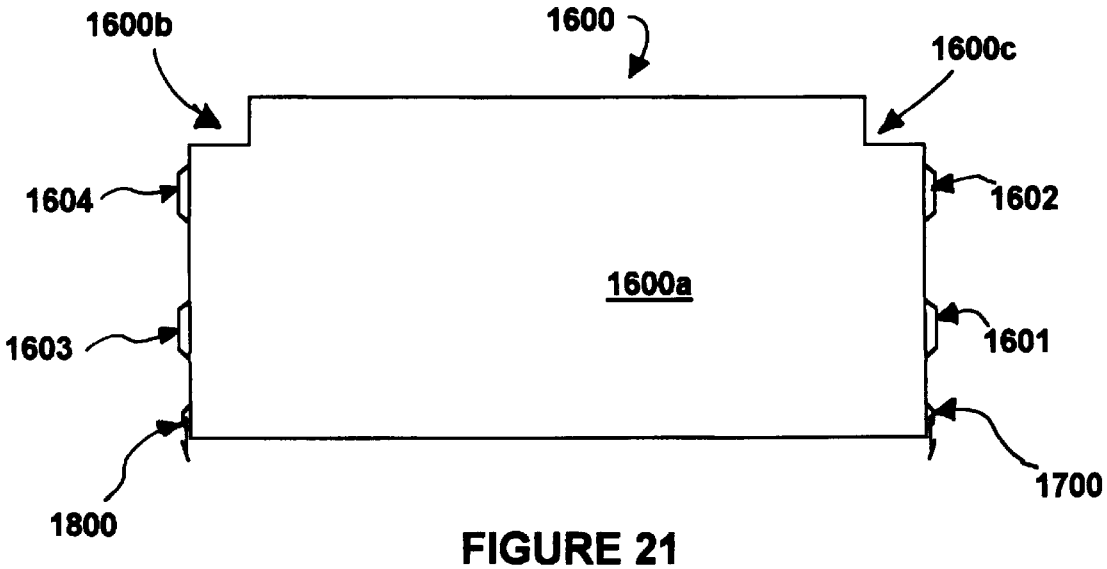
FIG. 21 is a top view of the pleiobox of the invention as shown in FIGS. 1B and 20.

In FIGS. 20 and 21, the pleiobox 1600 is shown. FIG. 20 is a perspective view of the pleiobox 1600, while FIG. 21 is a top view that reveals handles 1603, 1604 and clasp 1800. The construction of the pleiobox 1600 is substantially identical to that of the steps 13–15 as described above with reference to FIGS. 15–18. The main differences being that the overall size of the pleiobox 1600 necessitates the addition of handles 1601–1604 for easier movement by a user. While four protruding handles are shown, it is possible that a single indented slot on each side of the pleiobox 1600 (or any similar type of handle) would also serve the purpose of providing handles. Moreover, a feature of the pleiobox 1600 is a top surface 1600*a* that is at least twice as large as the step surfaces. Such top surface 1600*a* provides buoyancy similar to that shown in FIGS. 4 and 6. Of note is the shape of the pleiobox 1600, which includes indents 1600*b* and 1600*c*. The indents 1600*b* and 1600*c* match the shape of supports 19*d* and 19*c*, respectively as seen in FIG. 1. The indents 1600*b* and 1600*c* and clasps 1700 and 1800 thus secure the pleiobox 1600 from any horizontal movement. The inherent weight and large base of the pleiobox 1600 prevent vertical movement.

While dimensions, materials, and shapes have been specified above, it should be understood that modifications may be made that do not affect the underlying concept of the modular suspended flooring and step arrangement presented herein. Further, additional elements such as non-skid materials applied to all bottom surfaces to enhance safety in use of the present invention are also considered to be within the intended scope of the invention. Accordingly, it should be understood that the preferred embodiments mentioned here are merely illustrative of the present invention. Numerous variations in design and use of the present invention may be contemplated in view of the following claims without straying from the intended scope and field of the invention herein disclosed.

I claim:

1. An exercise device for providing a buoyant surface upon which exercise routines are performed, said exercise device comprising:

a planar surface;

a plurality of frame members secured peripherally around said planar surface, said plurality of frame members includes two lateral-members, two end-members connected between ends of said lateral-members, and four corner-supports located at an inner junction of each said end-member with each said lateral-member, said lateral-members and said end-members together form a substantially rectangular frame;

a plurality of post-supports secured atop said substantially rectangular frame;

a plurality of adjustable-posts, each adjustable-post affixed to one of said post-supports; and at least one guide rail pivotably attached between two of said adjustable-posts;

wherein said planar surface and said plurality of frame members form a suspended flooring, said suspended flooring being resilient when a force is placed upon said planar surface.

2. The exercise device as claimed in claim 1, wherein each said adjustable-post is telescopingly adjustable in a vertical direction so as to enable an incline of said at least one guide rail, each said adjustable-post having multiple index-holes and a means for securing said adjustable-post in multiple vertical positions that each correspond to one of said multiple index-holes.

3. The exercise device as claimed in claim 2, further including a plurality of pins and at least one step, wherein said lateral-members of said frame each include a pin-plate, said pin-plate being embedded in a recessed manner from an underside of each said lateral-members, said pin and said pin-plate both being formed so as to securely but removably attach to one another.

4. The exercise device as claimed in claim 3, wherein each said pin is cylindrical and has one threaded-end, each said pin-plate having a plurality of threaded-holes designed to accept each said threaded-end, each said lateral-member having through-holes that align with said plurality of threaded-holes, and said step having through-holes that are alignable with said through-holes of each said lateral-member.

5. The exercise device as claimed in claim 4, wherein said exercise device includes more than one of said steps, each said step providing a buoyant surface upon which exercise routines are performed and each said step including a planar step-surface, and a plurality of step-frame members secured peripherally around said planar step-surface, wherein said planar step-surface and said plurality of step-frame members form a suspended step-platform, said suspended step-platform being resilient when a force is placed upon said planar step-surface.

6. The exercise device as claimed in claim 5, wherein said exercise device includes a pleiobox, said pleiobox providing a top-most buoyant surface upon which exercise routines are performed and said pleiobox including a planar top-surface, and a plurality of pleiobox-frame members secured peripherally around said planar top-surface, wherein said planar top-surface and said plurality of pleiobox-frame members form a suspended pleiobox-platform, said suspended pleiobox-platform being resilient when a force is placed upon said planar top-surface.

7. The exercise device as claimed in claim 6, wherein each said step is formed in varying thicknesses relative to one another.

8. An exercise device for providing a buoyant surface upon which exercise routines are performed, said exercise device comprising:

a planar surface formed from a single sheet of flexible material; and a frame secured peripherally around said planar surface, said frame having a thickness, said frame is a substantially rectangular frame that includes two lateral-members, two end-members connected between ends of said lateral-members, and four corner-supports located at an inner junction of each said end-member with each said lateral-member;

wherein said planar surface and said frame form a suspended flooring that is elevated from any surface underlying said exercise device by a distance equal to said thickness of said frame minus a thickness of said single sheet of flexible material, said suspended flooring being resilient when a force is placed upon said planar surface.

9. The exercise device as claimed in claim 8, further including at least two post-supports, each post-support mounted atop a corner of said frame, at least two adjustable-posts, each adjustable-post mounted to one of said post-supports, at least two fixed-pivot-plates, each fixed-pivot plate mounted to one of said adjustable-posts, at least one single-pivot-plate, at least one multi-pivot-plate, and at least one guide rail, said single-pivot-plate mounted at a first end of said guide rail and said multi-pivot-plate mounted at a second end of said guide rail, wherein each said single-pivot-plate and said multi-pivot-plate is pivotably attached to one of said fixed-pivot-plates.

10. The exercise device as claimed in claim 9, wherein each said adjustable-post is formed by an upper section and a lower section, said upper section being of a lesser cross-sectional dimension than said lower section such that each said adjustable-post is telescopingly adjustable in a vertical direction so as to enable an incline of said at least one guide rail, each said adjustable-post having multiple index-holes located within said upper section and a single-index-hole located within said lower section such that said single-index-hole and any one of said multiple index-holes are alignable so as to allow passage therethrough of a means for preventing movement of said upper section within said lower section.

11. The exercise device as claimed in claim 10, further including a plurality of pins and at least one step, wherein said lateral-members of said frame each include a pin-plate, said pin-plate being embedded in a recessed manner from an underside of each said lateral-members, said pin being threadingly attachable to said pin-plate.

12. The exercise device as claimed in claim 11, wherein each said lateral-member includes through-holes that align with said plurality of threaded-holes, and said step includes through-holes that align with said through-holes of each said lateral-member.

13. The exercise device as claimed in claim 12, wherein said exercise device includes more than one of said steps, each said step providing a buoyant surface upon which exercise routines are performed and each said step including a planar step-surface formed from a single sheet of said flexible material that forms said planar surface of said suspended flooring, and a step-frame secured peripherally around said planar step-surface, said step-frame having a frame thickness, wherein said planar step-surface and said step-frame form a suspended step-platform, said suspended step-platform being resilient when a force is placed upon said planar step-surface.

14. The exercise device as claimed in claim 13, wherein said exercise device includes a pleiobox, said pleiobox providing a top-most buoyant surface upon which exercise routines are performed and said pleiobox including a planar top-surface, and a plurality of pleiobox-frame members secured peripherally around said planar top-surface, wherein said planar top-surface and said plurality of pleiobox-frame members form a suspended pleiobox-platform, said suspended pleiobox-platform being resilient when a force is placed upon said planar top-surface.

15. The exercise device as claimed in claim 14, wherein each said step-frame is formed in varying frame thickness so as to provide variable height arrangements through stacking of said steps one upon another.

16. An exercise device having modular elements upon which exercise routines are performed, said exercise device comprising:

a suspended flooring having a planar surface formed from a single sheet of flexible material and a frame secured peripherally around said planar surface, said frame having a thickness, wherein said planar surface is elevated from any surface underlying said exercise device and said suspended flooring is resilient when a force is placed upon said planar surface;

more than one step, each said step providing a buoyant surface upon which exercise routines are performed and each said step having a planar step-surface formed from a single sheet of said flexible material that forms said planar surface of said suspended flooring and a step-frame secured peripherally around said planar step-surface, said step-frame having a frame thickness, wherein said planar step-surface and said step-frame form a suspended step-platform, said suspended step-platform being resilient when a force is placed upon said planar step-surface; and a pleiobox, said pleiobox providing a top-most buoyant surface upon which exercise routines are performed and said pleiobox has a planar top-surface and a plurality of pleiobox-frame members secured peripherally around said planar top-surface, wherein said planar top-surface and said plurality of pleiobox-frame members form a suspended pleiobox-platform, said suspended pleiobox-platform being resilient when a force is placed upon said planar top-surface;

wherein said pleiobox abuts said steps and said pleiobox together with said steps are alignable atop said suspended flooring.

* * * * *